United States Patent [19]

Tanaka

[11] Patent Number: 4,740,936

[45] Date of Patent: Apr. 26, 1988

[54] ALARM ON-OFF MECHANISM FOR ALARM WATCH

[75] Inventor: Nobuhiro Tanaka, Tokyo, Japan

[73] Assignee: Seikosha Co., Ltd., Tokyo, Japan

[21] Appl. No.: 940,518

[22] Filed: Dec. 10, 1986

[30] Foreign Application Priority Data

Dec. 24, 1985 [JP] Japan ..... 60-198707

[51] Int. Cl.[4] ..... G04B 29/00

[52] U.S. Cl. ..... 368/319; 368/308; 368/74

[58] Field of Search ..... 368/72, 73, 262, 263, 368/264, 265, 306, 307, 308, 319, 320, 321

[56] References Cited

U.S. PATENT DOCUMENTS 1,951,391 3/1934 Borst ..... 368/96
3,039,260 6/1962 Morrison et al. ..... 368/263
4,021,046 5/1977 Barlow ..... 368/96
4,362,393 12/1982 Tissot ..... 368/96
4,464,060 8/1984 Schneider ..... 368/96

FOREIGN PATENT DOCUMENTS 818272 10/1951 Fed. Rep. of Germany ..... 368/96
818629 3/1952 Fed. Rep. of Germany ..... 368/96

*Primary Examiner*—Bernard Roskoski
*Attorney, Agent, or Firm*—Bruce L. Adams; Van C. Wilks

[57] ABSTRACT

An alarm on-off mechanism for an alarm watch is provided wherein two alarm push-pieces are symmetrically provided on opposite sides of the watch case. An alarm lever is interlocked with the alarm push-pieces in such a manner that the alarm is turned on by pressing one of the alarm push-pieces and the alarm is turned off by pressing the other alarm push-piece.

7 Claims, 1 Drawing Sheet

ALARM ON-OFF MECHANISM FOR ALARM WATCH

BACKGROUND OF THE INVENTION (1) Field of the Invention

The present invention relates generally to an alarm watch, and in particular, to an "analog" alarm watch.

(2) Background Information

In a conventional analog alarm watch, an alarm push-piece is also used as a hand-setting button or is provided separately from a hand-setting button. In either case, the on or off state of an alarm is selected by pushing in an alarm push-piece, as shown by the solid lines in FIG. 4, described hereinafter or pulling it out, as shown by the broken lines in the same drawing.

In the conventional art, not problem is raised when the alarm push-piece is pushed in, but there is a disadvantage in that the operation of pulling it out is difficult. In particular, when the alarm push-piece is not provided on the side of the case, as shown in FIG. 4, but is provided near the strap, there is a disadvantage in that the operation of pulling it out is difficult.

SUMMARY OF THE INVENTION

One object of the present invention is to provide a device capable of solving this problem, and comprises two alarm push-pieces which are symmetrically provided in a watch case. An alarm lever is provided which is engaged with the alarm push-pieces and is interlocked therewith, the alarm being turned on by pressing one of the alarm push-pieces and turned off by pressing the other alarm push-piece.

DESCRIPTION OF THE PREFERRED EMBODIMENT

Figure 1:
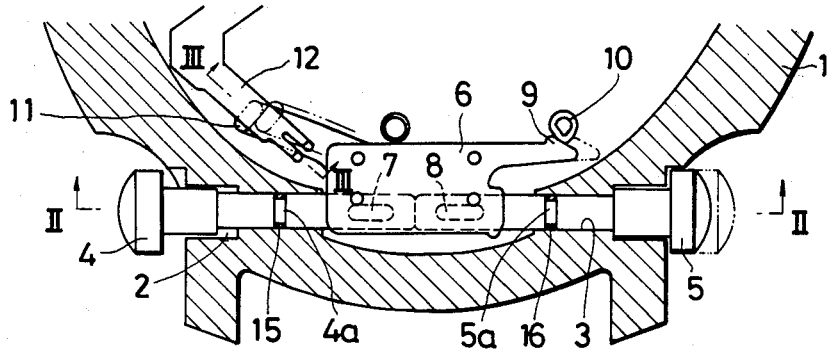
FIG. 1 is a sectional view through an embodiment of the present invention.
Figure 2:
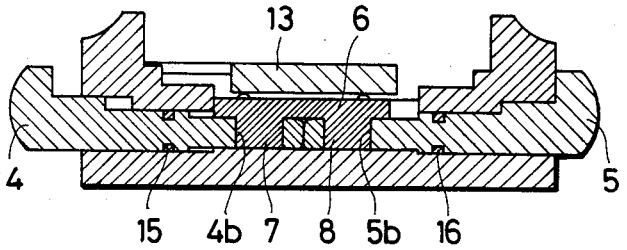
FIG. 2 is a sectional view taken along the line II—II in FIG. 1.
Figure 4:
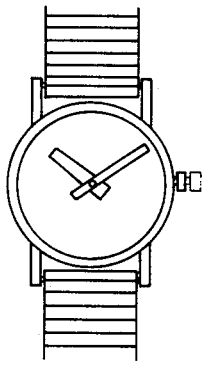
FIG. 4 is a plan view of a conventional alarm watch.
Figure 3:
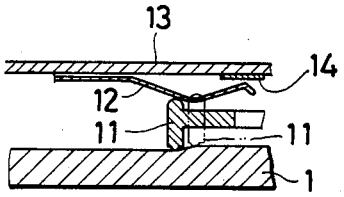
FIG. 3 is a sectional view taken along the line III—III in FIG. 1.

In FIGS. 1 to 3, a case 1 of a watch has holes or channels 2, 3 which are symmetrically provided near where a watch strap is connected to the case and in which alarm push-pieces 4, 5 are respectively inserted. The stems of the alarm push-pieces 4, 5 are respectively provided with grooves 4*a*, 5*a* in which packing pieces 15, 16 are inserted. Holes 4*b*, 5*b* are formed at the ends of the alarm push-pieces 4, 5, respectively. An alarm lever 6 is provided with pins 7, 8 which engage with the holes 4*b*, 5*b*, respectively. Therefore, the alarm push-pieces 4, 5 and the alarm lever 6 move together. A click piece 9 is formed on the alarm lever 6 and comprises a click mechanism in combination with a pin 10 which is provided on the case 1. An operating portion 11 of the alarm lever 6 brings an alarm-stopping contact piece 12 into contact with a conductor 14 provided on a base plate 13 and separates it therefrom. Thus, the contact piece 12 is separated from the conductor 14 when the mechanism is in the state shown by solid lines in FIGS. 1, 3 resulting in the alarm being turned off or stopped. As viewed in FIG. 1, when the alarm push-piece 4 on the left side is pressed, the alarm lever 6 moves to the right and the operating portion 11 moves to the position shown by broken lines in FIGS. 1 and 3, so that the contact piece 12 is pushed upward and is brought into contact with the conductor 14. This places the alarm in the on state. In complementary manner, when the alarm push-piece 5 on the right is pressed, the alarm is placed in the off state.

The device of the invention makes it possible to turn the alarm push-pieces of an alarm watch on or off by simply pressing them, so that its operation is simple.

What is claimed is:

1. An alarm on-off mechanism for an alarm watch comprising: multiple symmetrically opposed physically interconnected alarm push-pieces symmetrically provided on a watch case and axially aligned and movable in channels symmetrically opposed to one another, an alarm lever engagingly connecting said alarm push-pieces and physically interlocked therewith, and an alarm contact piece operated by a portion of said alarm lever responsive to axial movement of said alarm push-pieces to thereby engage and disengage said alarm.

2. An alarm mechanism according to claim 1; wherein axial movement of one of said alarm push-pieces engages said alarm contact piece and a conductor and axial movement of another of said alarm push-pieces disengages said contact piece and said conductor.

3. An alarm mechanism according to claim 1; wherein said alarm lever has an operating portion forming a part thereof, said operating portion abutting said alarm contact piece to engage and disengage said contact piece from a conductor responsive to alternating axial movements of said alarm push-pieces.

4. An alarm mechanism according to claim 1; wherein said alarm is turned on by pressing one of said alarm push-pieces and said alarm is turned off by pressing another of said alarm push-pieces.

5. An alarm mechanism according to claim 1; wherein holes are provided in said alarm push-pieces, and pins are provided on said alarm lever and inserted in said holes to engagingly connect said alarm lever to said alarm push-pieces, said alarm lever also having a click piece formed thereon which engages a separate pin within said alarm watch.

6. An alarm watch having an alarm on-off control comprising: symmetrically aligned multiple alarm push-piece means mounted on a watch case in opposing relation to one another for controlling said alarm, said alarm push-piece means extending outside said watch case on opposite sides thereof, alarm actuation means engagingly connected to each of said alarm push-pieces and physically interlocked in a straight line therewith, and alarm contact means for operatively engaging and disengaging a conductor responsive to alternate axial movements of said alarm push-pieces.

7. An alarm mechanism for a timepiece comprising a timepiece case, two axially aligned alarm push-pieces which are slideably mounted in channels in the case and are physically interconnected for movement together in unison by an alarm lever having an alarm operating portion which is disposed within said case and which engages and disengages an alarm contact piece, the arrangement being such that the alarm contact piece is movable into an operable position by pressing in one of the alarm push-pieces and is movable into an inoperable position by pressing in the other alarm push-piece.

* * * * *